US008458990B1

(12) United States Patent
Hendrix

(10) Patent No.: US 8,458,990 B1
(45) Date of Patent: Jun. 11, 2013

(54) GENERAL AND MEDICINAL SORTING DEVICE

(76) Inventor: Glen Hendrix, Houston, TX (US)

( * ) Notice: Subject to any disclaimer, the term of this patent is extended or adjusted under 35 U.S.C. 154(b) by 227 days.

(21) Appl. No.: 12/932,599

(22) Filed: Mar. 1, 2011

(51) Int. Cl.
*B65B 5/06* (2006.01)

(52) U.S. Cl.
USPC ..... 53/147; 53/153; 53/539; 53/542; 206/534; 206/538; 220/752

(58) Field of Classification Search
USPC ..... 53/153, 539, 147, 542, 543; 206/538, 206/534; 220/752
See application file for complete search history.

(56) References Cited

U.S. PATENT DOCUMENTS

D430,392 S * 9/2000 Noble ..... D3/203.3
2006/0144748 A1* 7/2006 Slaughter ..... 206/538

* cited by examiner

*Primary Examiner* — Hemant M Desai

(57) ABSTRACT

A device to assist in sorting and organizing any small items and, in particular, vitamins, supplements and prescription medications consisting of a series of folding, hinged panels that fold out to form troughs and transverse dividers that fit into the troughs to form bins. Once the bins are filled, the dividers are sequentially removed to allow the bin contents to be shoved along the trough into a small, resealable plastic bag for convenient storage and transportation. This saves time for people taking several different kinds of pills every day. Each pill bottle is located, opened, closed and stored away only once versus hundreds of times without using this device.

6 Claims, 3 Drawing Sheets

GENERAL AND MEDICINAL SORTING DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

Field of the Invention

A device to assist in the sorting and organizing of vitamins, minerals, supplements or prescription medications in pill, tablet, capsule or caplet form in a timely and labor-saving manner. The device may also be applied to the sorting and organizing of any small item such as small machine parts, seeds, mineral samples, etc.

It is an object of the present invention to provide a tool that makes the sorting of medications and supplements less time consuming and more convenient.

It is another object of the present invention to provide a tool for the sorting of a variety of numerous small objects from machined parts to mineral specimens.

It is another object of the present invention to provide a means for quickly and easily transferring sorted material from its bin to a plastic bag quickly and easily with a minimum risk of spillage.

It is another object of the present invention to allow time-indicative labeling and content labeling of any type to be applied as an aid in regimen adherence.

It is another object of the present invention to allow the sorting bin size to range from very small to relative large matching the users needs.

It is another object of the present invention to fold up for easy storage and portability.

It is another object of the present invention to be easily cleaned.

It is another object of the present invention to provide dividers that can be labeled with an erasable marker for precise and assured sorting, then erased and re-labeled when supplements or dosages change.

It is another object of the present invention to be easily imprinted with marketing, advertising or business information and used as a premium.

It is another object of the present invention to allow the portability of multiple doses of supplements and/or medications without having to carry around bulky, heavy pill containers.

BRIEF SUMMARY OF THE INVENTION

Vitamins, minerals and various plant and animal derived supplements are becoming more and more popular. Also, as the baby boomer generation ages, prescription medicines become more numerous and necessary. So much so that many people are facing a daily chore of repetitively locating and opening a number of containers to get one or more pills and then closing and storing them away.

The present invention is a time and motion saving device that allows one to sort and organize a large number of pills at one time. This allows the retrieval, opening and closing of bottles or prescription containers to be performed just once a week to once every month or so instead of once or more daily. It also allows the easy portability of multiple doses of pills without lugging around bulky, heavy pill containers.

The present invention consists of a series of panels connected edge to edge by a continuous hinge. These panels fold against each other in alternating fashion such as a bellows or accordion. When unfolded on a flat surface the panels form peaks and troughs. Notches in the peaks align with each other from peak to peak and are spaced equally about ½" apart along the peak. These notches receive dividers that are shaped to fit the triangular troughs.

In use, the present invention is spread apart so that a divider can be inserted into a row of notches. The divider can be adjusted from row to row of notches to provide the size bins necessary for what is being sorted—for instance, a large number of big capsules versus only a few small tablets. The bins can vary in length from about ½" up to nearly 4" in length. (This is not to say the device cannot be scaled up or scaled down for special applications.)

This is an example of how the device will be used to save time and motion. An individual wants to presort and pack his supplements for the next two weeks so that he or she does not have to open the same bottles several times a day. Besides, they like to take their vitamins at work and don't want to lug all those bottles back and forth. This individual has twelve supplements that take every day. That is quite a few pills so the dividers are placed so that it forms rows of bins that are one inch long. This forms sixty-three bins. A different supplement is placed in each bin until each bin has twelve. Now the device is moved to the edge of the table and the nearest divider is lifted out of the way. Using a triangular-shaped scraper that matches the trough profile, the pills in each trough are shoved out into a small plastic re-sealable bag. Because of the triangular geometry of the troughs they fit right into the bags and transfer of the pills to their respective little storage bags is quick, easy and efficient. This process is repeated until all of the pills have been bagged. These bags are about 2" by 3" with a re-sealable plastic seat at the top and are readily available from any pharmacy and can be labeled with permanent markers, ballpoint pen or erasable markers as to any special instructions. These bags can be recycled many times for the same purpose.

Notice that twelve bottles were opened one time each. Without this process, bottles would have to be retrieved and opened seven hundred and fifty-six times, a pill fished out, the bottles closed back up and stored away. Assuming it would take about fifteen seconds to find, open, dig a pill out, close and store each of the twelve bottles over the course of sixty-three days this takes about three hours. Now the supplements are in handy, easily transportable packets and more than three hours has been reduced to about ten minutes of activity using the current invention.

It is an object of the invention to provide a tool that makes the sorting of medications and supplements less time consuming and more convenient.

It is another object of the invention to provide for the quick, convenient sorting of a variety of numerous small objects ranging from machined parts to mineral specimens.

It is another object of the invention to provide a means for quickly and easily transferring sorted material from its bin to a plastic bag with a minimum risk of spillage.

It is another object of the invention to allow for time-related labeling and content labeling of any type to be applied for regimen adherence.

It is another object of the invention to allow the sorting bin size to range from very small to relative large, matching the user's needs.

It is another object of the invention to fold up for easy storage or portability.

It is another object of the of the present invention to allow the dividers to be labeled with an erasable marker for precise and assured sorting, then erased and re-labeled when supplements or dosages change.

It is another object of the present invention to be easily imprinted with marketing, advertising or business information and used as a premium.

It is another object of the present invention to provide a means of sorting groups of items and storing them with no limitation on quantity stored.

These and other objects and advantages of the present invention will become apparent from reading of the attached specification and appended claims.

DETAILED DESCRIPTION OF THE INVENTION

Figure 1:
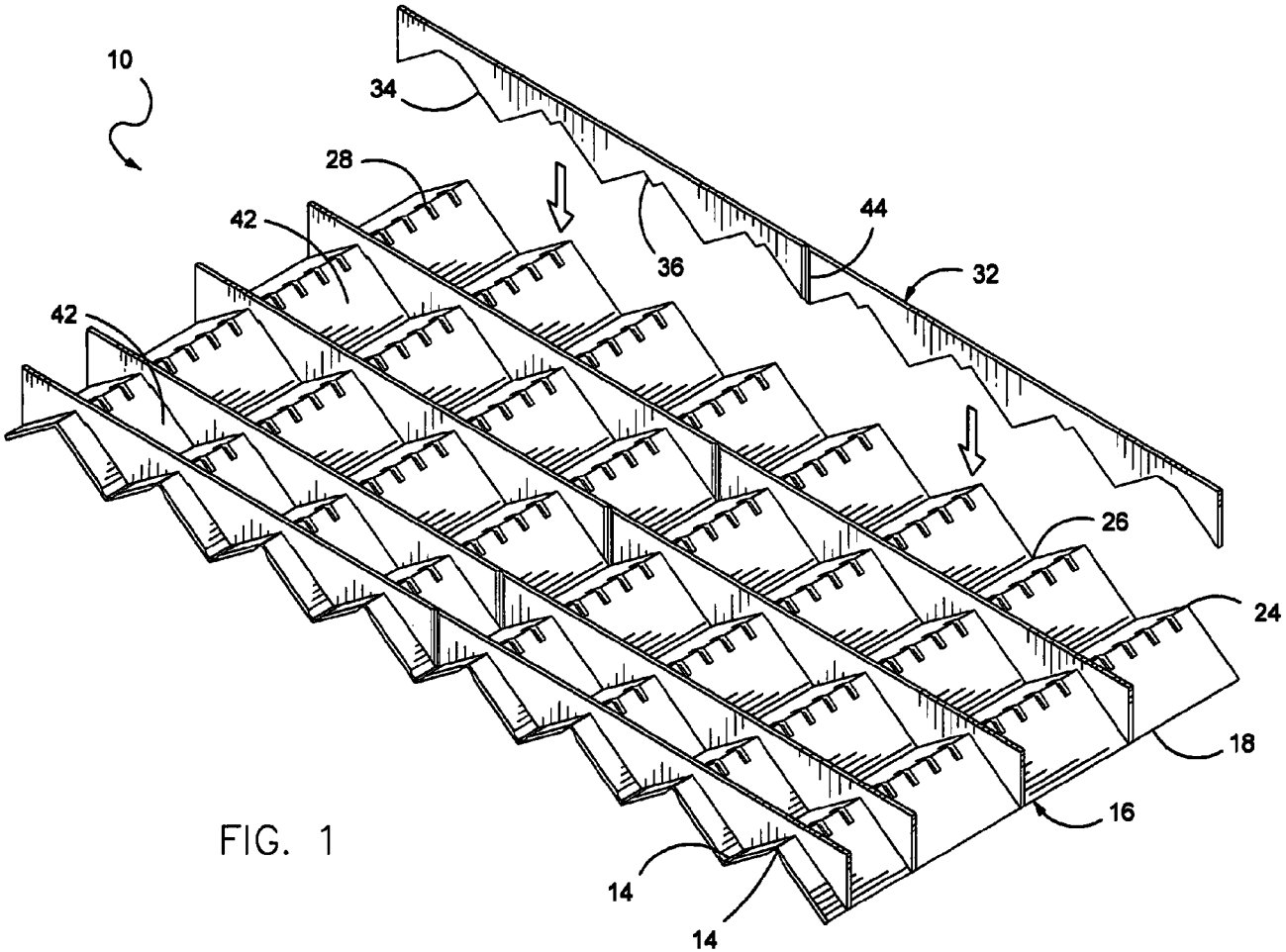
FIG. 1 shows a perspective view the device and how the dividers are installed.

FIG. 1 shows the present invention 10 in an unfolded position, ready for use. The body 16 of the present invention 10 consists of a series of rectangular panels 18 joined together at their longer sides by a hinge 14. This allows the panels 18 to be folded up accordion style for storage or spread out for use. Along each peak 24 of the body 16 are a series of notches 28. These rectangular notches 28 are approximately ½" apart and ⅜" deep. As shown in FIG. 1, one of several dividers 32 is being put in place. The divider 32 has large inverted triangles 34 that match the troughs 26 of the body 16. The small inverted triangles 36 between the large inverted triangles 34 of the divider 32 fit into the notches 28 on the peaks 24 of the body 16. The dividers 32 fit tightly against the panels 18 of the body 16 to form the walls of the bins 42 and serve to evenly space the peaks and troughs of the body 16. The present invention 10 forms a total of one hundred nineteen bins 42 when all dividers 32 are in place. The number of bins depends on the number of peaks and valleys and rows of notches. Each divider 32 has a hinge 44 at midpoint so that it can be folded in half to approximate the length of the body 16 for storage purposes.

Figure 2:
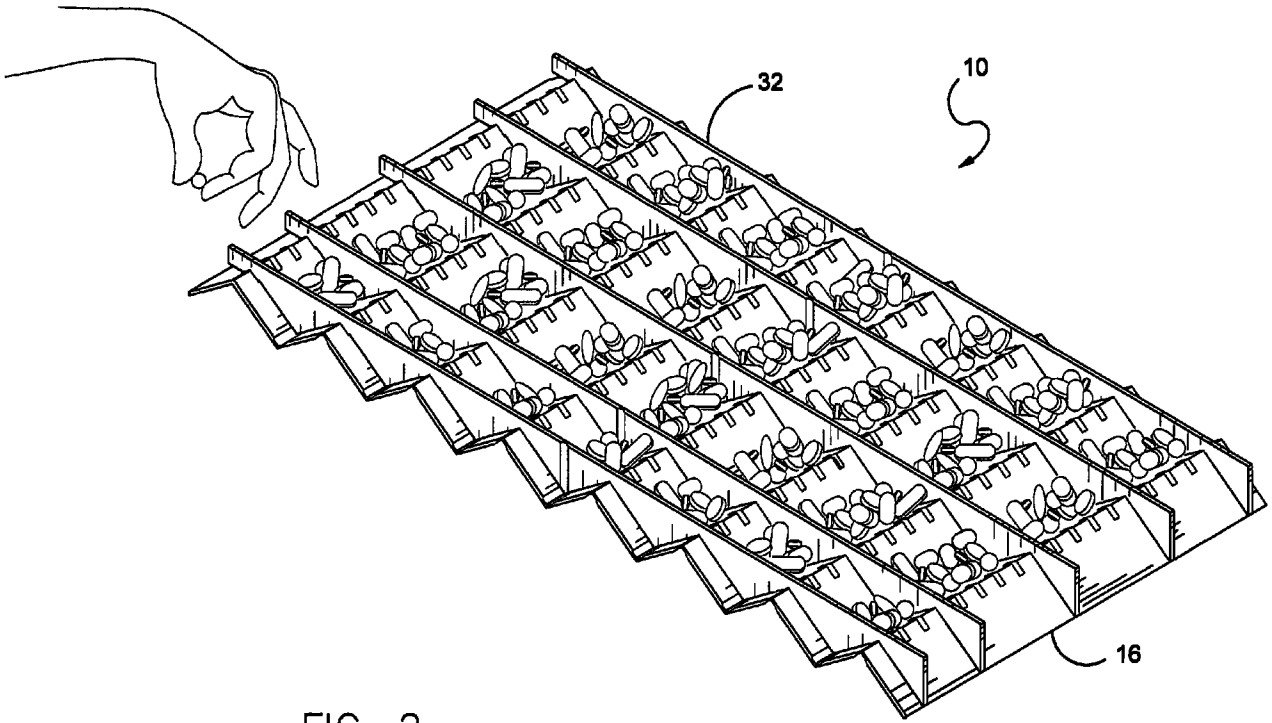
FIG. 2 shows a perspective view of the device being used to sort supplements.

FIG. 2 gives a perspective view of the present invention 10 after a number of supplements have been sorted.

Figure 3:
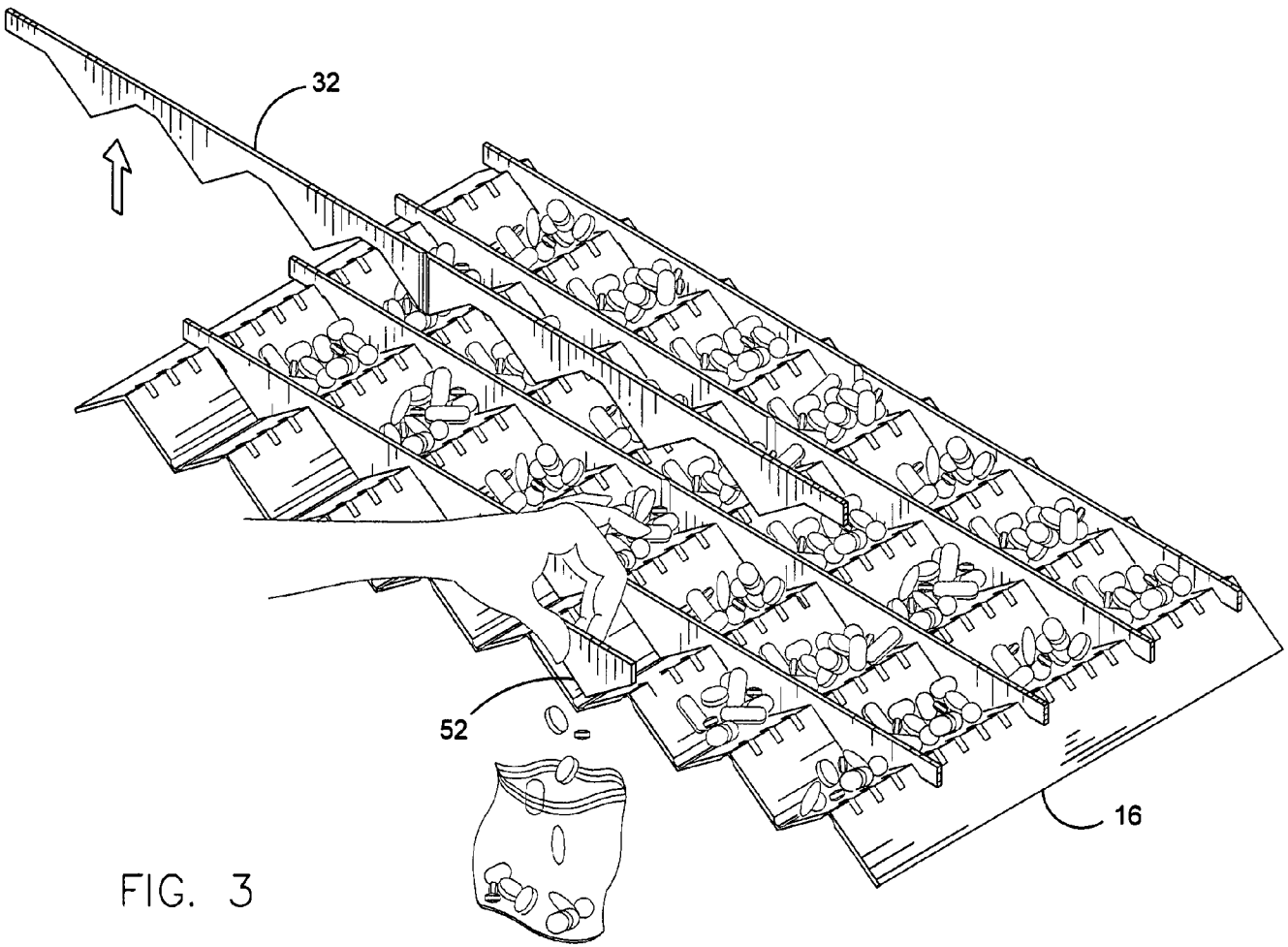
FIG. 3 shows a perspective view of the device as the dividers are removed and bin contents are scraped into plastic bags.

FIG. 3 shows the contents of the bins 42 being transferred to small plastic bags to be labeled and stored. After each divider 32 is removed a triangular scraper 52 slides the supplements or medications along the length of the trough 26 and into a bag.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A device for organizing different supplements and medication in the form of pills, tablets or capsules into a quantity of discrete, similar groups for easy storage and retrieval comprising:

a means for forming a plurality of parallel, hingedly connected and collapsible triangular open-ended troughs;

a means for partionally dividing and subdividing said troughs into variable sized bins in a repeatable manner;

a triangular planar means for removing the contents of each said bin into a receiving container.

2. The device of claim 1, wherein said means for forming said troughs are rectangular panels having a length of approximately 11" and a width of approximately 1" and a thickness of approximately 1/16" and the dividing means are panels approximately 1/16" thick with triangular shapes matching the sectional geometry and quantity of said triangular troughs with a portion of about an inch in addition to said triangular shape with its length spanning the quantity of said triangular troughs perpendicular to the axes of said triangular troughs.

3. The device of claim 1, wherein said triangular troughs have regular rows of notches at the tips of the walls of said triangular troughs receptive to a mating tab on said dividing means.

4. The device of claim 1, wherein said means for removing the contents of each said bin is a flat piece of material approximately 1/16" thick, a scraper, matching the triangular section of said troughs on its bottom portion and having enough material on its top portion extending above the triangular section to easily grasp and manipulate while scraping the length of a said triangular trough.

5. The device of claim 1, wherein said troughs, trough-dividing means and content-removal means are made of a material having the qualities of being imprintable, cleanable and repeatably labeled as with a dry-erase type marker and re-positionable labels.

6. A device for arranging objects into separate groups for transfer to a package comprising:

a plurality of open-ended parallel triangular troughs wherein said troughs are rectangular panels hingedly attached in a continuous manner along the length of said panels, foldable in an accordion manner for storage;

a means of repeatedly and removably dividing said troughs into variable size bins wherein said dividing means are thin flat partitions with their length spanning the quantity of said triangular troughs perpendicular to the axes of said troughs, said flat partitions having triangular shapes matching the sectional geometry of said triangular troughs at its lower extremity and a portion of material above the triangular shapes along the length of said partition.

* * * * *